United States Patent [19]

Yamada et al.

[11] Patent Number: 4,829,330

[45] Date of Patent: May 9, 1989

[54] AUTOMATIC IMAGE DEVELOPING APPARATUS FOR SILVER HALIDE PHOTOGRAPHIC PHOTOSENSITIVE MATERIAL

[75] Inventors: Minoru Yamada; Kunio Seto, both of Minami-ashigara, Japan

[73] Assignee: Fuji Photo Film Co., Ltd., Kanagawa, Japan

[21] Appl. No.: 71,830

[22] Filed: Jul. 10, 1987

[30] Foreign Application Priority Data

Jul. 10, 1986 [JP] Japan ..... 61-163217

[51] Int. Cl.[4] ..... G03D 3/02; G03D 3/13

[52] U.S. Cl. ..... 354/322; 354/325

[58] Field of Search ..... 354/320, 321, 322, 324, 354/325

[56] References Cited

U.S. PATENT DOCUMENTS 4,034,389 7/1977 Huss ..... 354/320

4,123,769 10/1978 Fernandez et al. ..... 354/325

4,252,429 2/1981 Hope et al. ..... 354/322

*Primary Examiner*—A. A. Mathews

*Attorney, Agent, or Firm*—Sughrue, Mion, Zinn, Macpeak & Seas

[57] ABSTRACT

An automatic image developing apparatus for a halide silver photographic photosensitive material includes a developing tank, a fixing tank, and a washing tank for successively delivering therethrough the halide silver photographic photosensitive material which has been exposed or has recorded an image thereon. The washing tank is supplied with washing water at a rate of 2 liters or less per 1 $m^2$ of the photographic photosensitive material. The apparatus also has a plurality of roller pairs for squeezing water from the photographic photosensitive material fed from the washing water toward a drying unit, and a roller washing unit associated with at least a first one of the roller pairs which is closest to the washing tank to grip the photographic photosensitive material from the washing tank, for washing said at least one roller pair at all times.

15 Claims, 4 Drawing Sheets

AUTOMATIC IMAGE DEVELOPING APPARATUS FOR SILVER HALIDE PHOTOGRAPHIC PHOTOSENSITIVE MATERIAL

BACKGROUND OF THE INVENTION

The present invention relates to an automatic image developing apparatus for a silver halide photographic photosensitive material, and more particularly to an automatic image developing apparatus for automatically developing an image on a silver halide photographic photosensitive material after it has been exposed or the image has been recorded thereon by feeding the photosensitive material successively through developing, fixing, and washing tanks, the automatic image developing apparatus being capable of saving as much washing water as possible which is to be supplied to the washing tank, of preventing processing chemicals from being transferred to the photosensitive material thereby to avoid contamination of the image, and of storing the developed photosensitive material for a long period of time.

Radiation image recording systems are widely used in the medical field for obtaining information on affected parts of patients. In such a radiation image recording system, a patient to be examined is exposed to radiation, and obtained radiation image information is recorded on a film of silver halide black-and-white photographic photosensitive material. Then, the photosensitive film with the image recorded thereon is fed into an automatic image developing apparatus.

In the automatic image developing apparatus, the film is first delivered into a developing tank containing a developing solution, and then passed through a fixing tank containing a fixing solution, after which the film is put into a washing tank containing washing water. Then, the film is passed through a squeezing unit having rollers which squeeze water out of the film, and delivered into a drying unit in which hot air at a temperature ranging from about 50° C. to 55° C. is applied to the film to dry the same. Subsequently, the film is stored in a prescribed storage location and will be used for medical diagnosis or the like when required.

The water tank is disposed in the automatic image developing apparatus for washing the film that has been immersed in and passed through the developing and fixing solutions, as described above. The washing tank is supplied at all times with a large amount of washing water (for example, 3 liters or more of washing water for 1 $m^2$ of the photosensitive material) to keep the water in the washing tank clean.

However, supplying the washing tank with a great amount of washing water at all times is highly uneconomical and does not meet recent growing demands for the saving of resources.

If the amount of water to be supplied to the washing tank were to be considerably reduced, washing water would be left stagnant in the washing tank over a long interval of time, forming bacterial slime in the water or permitting the water to be rotten to give off an ill odor. If the automatic image developing apparatus were stopped in operation for several consecutive days, floating matters would form in the washing water, and would tend to attach to the film or clog a filter in the apparatus when the apparatus is started again. To avoid the above problems, the wahing tank would have to be cleaned periodically, and such a cleaning process would be time-consuming and would exert an undue burden on the worker.

Various automatic image developing apparatus have heretofore been proposed for effectively waving washing water to be supplied to the washing tank. One example is a countercurrent washing process which employs a multiplicity of washing tank. More specifically, a plurality of washing tanks are disposed at different vertical levels in a step-like configuration, and a relatively small amount of washing water is supplied from the uppermost washing tank successively to the other lower washing tanks. At the same time, the film to be developed is washed by being successively immersed in and passed through the washing tanks.

With the automatic image developing apparatus of the aforesaid construction, however, a plurality of washing tanks are required, and so are feed rollers and racks associated with the respective washing tanks. As a result, the overall automatic image developing apparatus is large in size and fails to effectively utilize a space for image developing operation. This automatic image developing apparatus is also disadvantageous in that the cost of manufacture of the apparatus is very high.

In view of the aforesaid shortcomings, there have been proposed various image developing processes capable of preventing washing water from being rotten or preventing bacterial slime from forming in washing water thereby to greatly reduce the about of washing water to be supplied to the washing tank by adding a chelating agent or a biocide such as a halide (see Japanese Patent Applications Nos. 60-253807 and 61-30305, for example). With these proposals, films can be washed for a long period of time even in a reservoir-type washing tank without increasing the size of the automatic image developing apparatus and while saving as much washing water as possible.

When washing a film with a reduced amount of washing water or a pool of washing water rather than a large amount of running washing water, thiosulfate and the like, for example, of the fixing solution are progressively delivered via the film and accumulated in the washing water in the washing tank as the developing process progresses. When the film is squeezed after it has been washed, therefore, thiosulfate and the like are squeezed out by the squeezing rollers and are often attached to these rollers. The squeezing unit is located closely to the drying unit.

While the developing process is being intermittently carried out, therefore, the squeezing rollers are rapidly dried by hot air from the drying unit when the developing process is not effected. At this time, thiosulfate is deposited in an irregular pattern and at a high density on the roller surfaces. If the washed film were fed by these rollers again, thiosulfate deposits would be attached to localized areas of the film surface, resulting in image density irregularities or surface reflection irregularities, or the localized film areas would be yellowed by such thiosulfate deposits during storage of the developed film over a long period of time.

SUMMARY OF THE INVENTION

It is a primary object of the present invention to provide an automatic image developing apparatus which is of a simple structure and a small size, and can be manufactured economically, the apparatus having roller washing means for cleaning at least a pair of rollers for squeezing water out of a photographic photosensitive material which has been immersed in and passed from tanks containing a fixing solution and washing water, so that processing solutions which have been attached to the rollers from the photographic photosensitive material having passed from a washing tank can be washed off by the roller washing means, for thereby saving as much washing water as possible which is to be supplied to the washing tank, for preventing the processing solutions from being attached to the squeezing unit thereby to facilitate a desirable developing process, and for improving the stability of developed images on the film.

Another object of the present invention is to provide an automatic image developing apparatus for a halide silver photographic photosensitive material, comprising a developing tank, a fixing tank, a washing tank for successively delivering therethrough the halide silver photographic photosensitive material which has been exposed or has recorded an image thereon, the washing tank being supplied with washing water at a rate of 2 liters or less per 1 $m^2$ of the photographic photosensitive material, a drying unit for drying the photographic photosensitive material, a plurality of roller pairs for squeezing water from the photographic photosensitive material fed from the washing water toward the drying unit, and roller washing means associated with at least a first one of the roller pairs which is closest to the washing tank to grip the photographic photosensitive material from the washing tank, for washing said at least one roller pair at all times.

Still another object of the present invention is to provide an automatic image developing apparatus, wherein the roller washing means comprises a roller washing water tank, said at least one roller pair having upper and lower rollers, at least the lower roller being partly immersed in the roller washing water tank.

Yet still another object of the present invention is to provide an automatic image developing apparatus, wherein the roller washing water tank is supplied with washing water, and includes means for introducing excessive washing water from the roller washing water tank into the washing tank.

A further object of the present invention it to provide an automatic image developing apparatus, wherein the introducing means comprises one side wall of the roller washing water tank, said one side wall being substantially shorter than an opposite side wall of the roller washing water tank.

A yet further object of the present invention is to provide an automatic image developing apparatus, wherein said one side wall has a recess which makes said one side wall shorter than the opposite side wall.

A still further object of the present invention is to provide an automatic image developing apparatus, wherein the introducing means comprises a washing water discharge hole defined in one side wall of the roller washing water tank.

A yet still further object of the present invention is to provide an automatic image developing apparatus, wherein the roller washing means comprises a roller washing water tank assembly including a first water tank and a second water tank, the roller pairs including said first roller pair associated with the first water tank and a second roller pair associated with the second water tank.

Another object of the present invention is to provide an automatic image developing apparatus, wherein the second water tank is disposed to deliver excessive washing water therefrom into the first water tank, and the first water tank is disposed to deliver excessive washing water therefrom into the washing tank.

Yet another object of the present invention is to provide an automatic image developing apparatus, wherein the roller washing means comprises a roller washing pipe disposed adjacent to the first roller pair and having an opening for ejecting washing water to one roller of the first roller pair to clean the first roller pair.

Yet still another object of the present invention is to provide an automatic image developing apparatus, further including a receiver tank for receiving and delivering washing water ejected from the roller washing pipe into the washing tank.

Still another object of the present invention is to provide an automatic image developing apparatus, wherein the receiver tank has longer and shorter side walls, the shorter side wall being arranged to allow washing water ejected from the roller washing pipe to overflow thereover into the washing tank.

A still further object of the present invention is to provide an automatic image developing apparatus, wherein the washing water comprises water with at least one compound selected from the group consisting of aminopolycarboxylic acids and phosphonic acids being added to the water.

A yet further object of the present invention is to provide an automatic image developing apparatus, wherein the washing water is processed by at least one of exposure to ultraviolet radiation, application of a magnetic field, and deionization with an ion exchange resin.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIGS. *2a* and *2b* are fragmentary perspective views of alternative squeezing units in the automatic image developing apparatus of the present invention.

DESCRIPTION OF THE PREFERRED EMBODIMENTS

Figure 1:
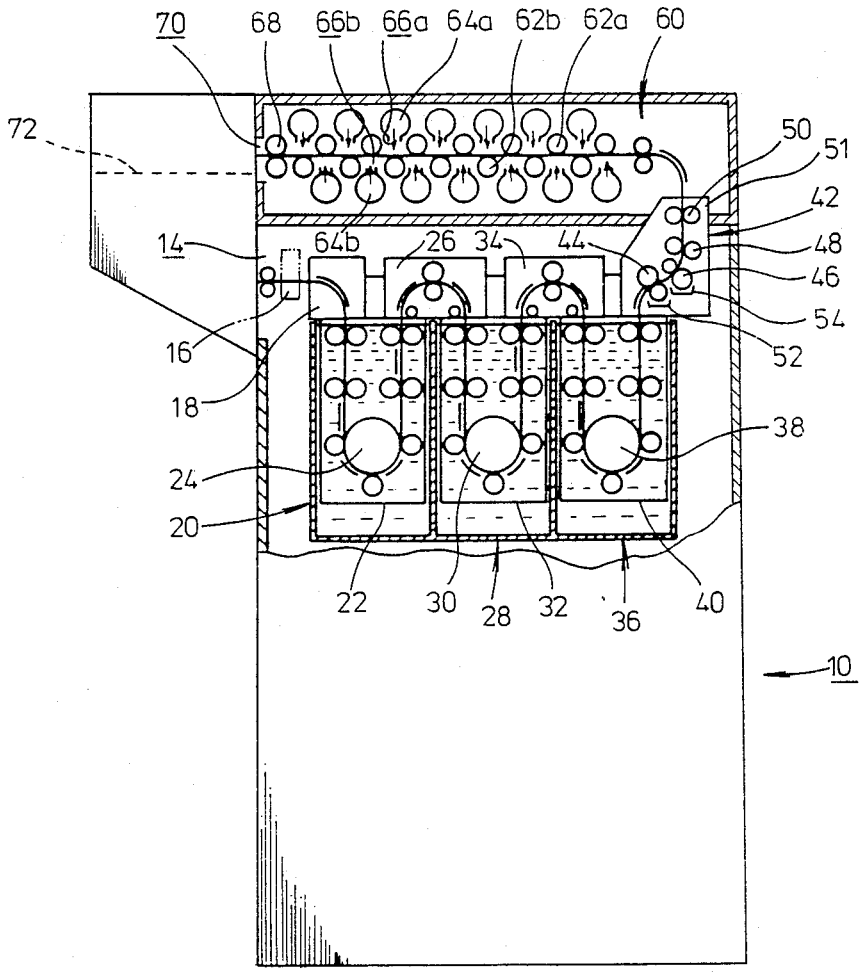
FIG. 1 is a schematic vertical cross-sectional view of an automatic image developing apparatus according to the present invention.

FIG. 1 shows an automatic image developing apparatus generally designated by the reference numeral 10. The automatic image developing apparatus 10 has a film inlet slot 14 for inserting an exposed film, such as an X-ray photographic photosensitive material RX manufactured by Fuji Photofilm Co., Ltd, into the apparatus, and a film detector 16 disposed in the vicinity of the film insertion slot 14. The film detector 16 comprises, for example, a pair of rollers and a microswitch, and detects when one film is inserted into the automatic image developing apparatus 10.

A first rack 18 is disposed near the film detector 16. The first rack 18 includes a curved guide for deflecting the film that has come from the film detector 16 through 90° and delivering the film into an image developing unit 20.

The image developing unit 20 includes a tank 22 containing a developing solution and accommodating therein a developing rack 24 comprising a plurality of rollers and guides.

The developing rack 24 has a terminal end connected to a second rack 26 comprising rollers and curved guides. The second rack 26 has an outlet coupling to an image fixing unit 28 including a fixing rack 30 having a plurality of rollers and guides. The fixing rack 30 is immersed in a fixing solution stored in a fixing tank 32. The fixing rack 30 has a terminal end joined to a third rack 34 comprising rollers and guides. The third rack 34 has an outlet joined to a washing rack 38 of a film washing unit 36. The washing rack 38 is immersed in washing water stored in a washing tank 40. The washing water may include a chelating agent, any of various biocides, or a mixture of a chelating agent and a biocide, for preventing the washing water from being rotten or preventing bacterial slime from being produced. The added chelating agent or biocide allows the washing water to be used for a long period of time without being replenished, thereby saving as much water as possible.

The washing rack 38 has a terminal end coupled to a squeezing unit 42 including a guide and roller pairs 44, 46, 48, 50 which are mounted on a pair of side plates 51. The squeezing unit 42 also includes water tanks 52, 54 for storing cleaning water to be supplied to the roller pairs 44, 46.

Figure 2A:
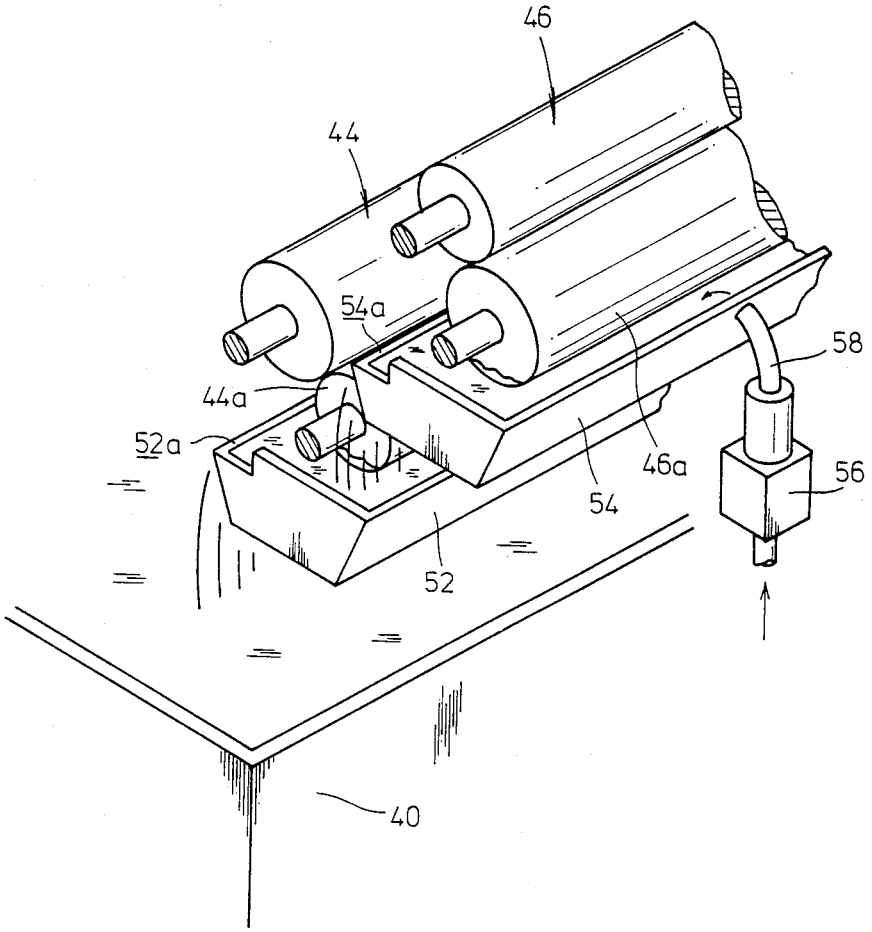
Figure 2B:
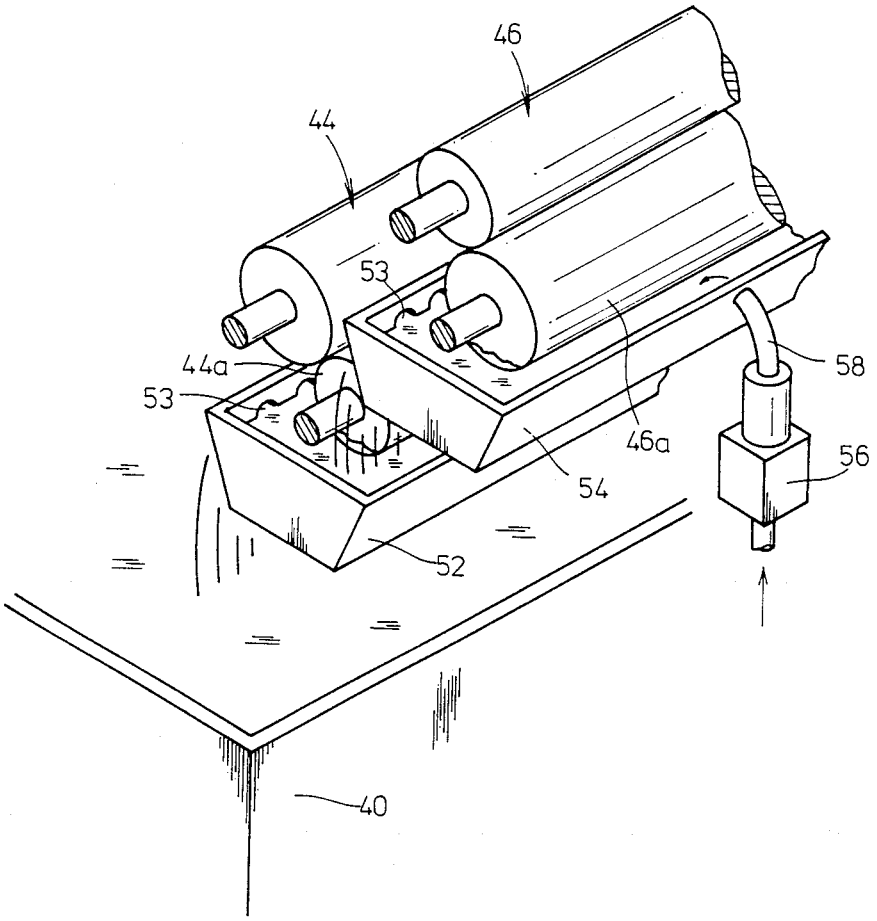

As shown in FIG. 2*a*, one roller **44*a* of the roller pair 44 is immersed to a certain depth in the washing water contained in the water tank 52, and one roller 46*a* of the roller pair 46 is immersed to a certain depth in the washing water contained in the water tank 54. The water tank 54 is positioned above the water tank 52. The water tanks 52, 54 have side walls with recesses 52*a*, 54*a* defined respectively therein. The water tank 54 is supplied with washing water from a pipe 58 connected to a pump 56. Therefore, any excessive washing water supplied to the water tank 54 flows via the recess 54*a* into the water tank 52, from which excessive washing water flows through the recess 52*a* into the washing tank 40. The water tanks 52, 54 may be formed with discharge holes 53** defined in side walls thereof as shown in FIG. 2*b*, rather than the recesses **52*a*, 54*b*, or may have shortened side walls to allow washing water to overflow the tanks. Alternatively, the water tanks 52, 54** may substantially be tilted to one side.

The squeezing unit 42 delivers the film into a drying unit 60 disposed above the racks 18, 26, 34 while deflecting the film fed vertically upwardly from the wahing unit 36. The drying unit 60 includes a roller group **62*a* comprising rollers disposed for contact with one side of the film, and a roller group 62*b* comprising rollers disposed for contact with the other side of the film, the rollers of the roller group 62*b* alternating with the rollers of the roller group 62*a*. Air ejecting pipes 64*a* are disposed near the roller group 62*a* in confronting relation to the respective rollers of the roller group 62*b*, and air ejecting pipes 64*b* are disposed near the roller group 62*b* in confronting relation to the respective rollers of the roller group 62*a*. The air ejecting pipes 64*a*, 64*b* have slits 66*a*, 66*b*, respectively, for ejecting hot drying air against the film as it is fed between the roller groups 62*a*, 62*b***.

The drying unit 60 also includes a pair of rollers 68 positioned near a film outlet slot 70 coupled to a film stacker 72.

Operation and advantages of the automatic image developing apparatus 10 thus constructed will be described below.

The automatic image developing apparatus 10 may employ the following processing solutions: The developing solution may be RD-V manufactured by Fuji Photofilm Co., Ltd. The developing solution is filled in the develoing tank 22 with a prescribed amount of starter added, and will be replenished at a rate of 50 ml/film size of 250×300 mm. The fixing solution may be Fuji F manufactured by Fuji Photofilm Co., Ltd., and will be replenished at a rate of 60 ml/film size of 250×300 mm. The washing tank 40 is filled with an aqueous solution of 0.5 g of disodium ethylenediaminetetraacetic acid-dihydrate per liter of water. The washing tank 40 will not be replenished except for making up for a reduction due to evaporation, and therefore is used as a reservoir-type washing tank. Each of the water tanks 52, 54 in the squeezing unit 42 is filled with 100 ml of the same aqueous solution as the washing water in the washing tank 40, and the rollers **44*a*, 46*a* are immersed respectively in the water tanks 52, 54**.

An exposed film introduced into the automatic image developing apparatus 10 passes through the film insertion slot 14 to the film detector 16. As the film passes through the film detector 16, it detects introduction of the film into the automatic image developing apparatus 10. The film which has left the film detector 16 is vertically fed by the first rack 18 under the control of a control unit (not shown), and then immersed in the developing solution in the tank 22 while being gripped by the developing rack 24. The film is deflected 180° in the tank 22 and delivered toward the second rack 26. The film that has reached the second rack 26 is deflected 180° again by the guides and rollers of the second rack 26, and then fed into the fixing rack 30 in which the film is immersed in the fixing solution stored in the tank 32 of the fixing unit 28. The film is thereafter delivered vertically upwardly toward the third rack 34, from which the film is fed vertically downwardly into the washing rack 38 where the film is washed with washing water in the tank 40 of the washing unit 36. After having been washed, the film is delivered into the squeezing unit 42 in which the film passes through the roller pairs 44, 46, 48, 50 that squeeze water out of the film, which is then guided into the drying unit 60.

In the drying unit 60, the film is delivered while its opposite surfaces are being held in rolling contact with the roller groups **62*a*, 62*b*. Upon travel through the drying unit 60, hot air at about 55° C. is applied from the hot air ejecting slits 66*a*, 66*b* of the air ejecting pipes 64*a*, 64*b* to the film to evaporate water attached to the opposite surfaces thereof. Therefore, when the film is delivered via the roller pair 68 and the film outlet slot 70 into the film stacker 72**, the developing process is completed and the film is completely dried.

As the developing process is repeatedly continued, components of the processing solutions such as thiosulfate are accumulated in the tank 40 of the washing unit 36. More specifically, the film in the automatic image developing apparatus 10 is first passed through the tank 22 storing the developing solution, then immersed in the tank 32 storing the fixing solution, and washed by the water stored in the tank 40. Thus, the developing and fixing solutions are attached to the film that has been introduced into the tank 40. Each time a film is immersed in the tank 40, therefore, the density of processing solution components in the washing water in the tank 40 is increased. The film that has been immersed in and passed through the tank 40 carries washing water containing processing solution components such as thiosulfate. Upon subsequent travel of the film through the roller pair 44 of the squeezing unit 42, such washing water is applied to these rollers.

According to the present invention, the roller 44*a* of the roller pair 44 is partly immersed in the washing water in the water tank 52. When the roller 44*a* rotates during the squeezing process, processing solution components deposited on the roller 44*a* from the film are mixed into the washing water in the water tank 52, and the roller pair 44 is kept clean at all times. Even if the developing process is intermittently carried out, since no processing solution components remain deposited on the roller pair 44, the film which has passed through the squeezing unit 42 does not carry on its opposite surfaces undesired deposits of processing solution components. Accordingly, the film is developed very well with high-quality images thereon.

The roller pair 46 adjacent to the roller pair 44 is also associated with the water tank 54. Thus, even if any processing solution components remain attached to the film that has left the roller pair 44, such remaining processing solution components are fully removed from the film by the roller 46*a* of the roller pair 46 which is partly immersed in the water tank 54. The squeezing unit 42 is therefore completely kept clean to make sure that the film can be developed without undesired deposits thereon.

The water tank 54 is supplied with washing water from the pipe 58 coupled to the pump 56. Excessive water from the water tank 54 overflows through the recess 54*a* into the water tank 52, from which it is fed via the recess 52*a* into the tank 40 of the washing unit 36. The water tanks 54, 52 may be of a capacity large enough to allow part of the rollers 44*a*, 46*a* to be immersed in the washing water in the water tanks 54, 52. As a result, washing water supplied from the pipe 58 into the water tank 54 can considerably be saved.

The results of an experiment conducted by the inventor using the automatic image developing apparatus 10 will be described below.

20 films of a size of 250×300 mm a day were developed for 6 consecutive days from Monday through Saturday. 20 minutes after the 19th film had been developed on the 6th day, the 20th film was developed, but no surface reflection irregularities and density irregularities were found, and an image suitable for medical diagnosis was obtained on the film. No bacterial slime was produced in the washing water in the tank 40.

In the same running experiment conducted without providing the water tanks 52, 54 in the squeezing unit 42, however, considerable surface reflection irregularities and density irregularities were found on the 20th film developed on the 6th day, and an image on the film was not suitable for medical diagnosis.

Discoloration of the film due to $S_2O_3$ salt remaining on the film after development was measured (silver nitrate method). During storage over a long period of time, any remaining $S_2O_3$ salt reacts with image silver and produces yellowing which is measured for detecting film discoloration. More specifically, the developed film is successively immersed each for about 3 minutes in a solution A containing 20 ml of acetic acid and 10 g of silver nitrate, a solution B containing 50 g of sodium chloride, and a solution C containing 50 g of sodium thiosulfate and 20 g of sodium sulfite. The increase in the yellowing density of the film which had been developed without the water tanks 52, 54 in the squeezing unit 42 was ten times that of the film which had been developed with the water tanks 52, 54 in the squeezing unit 42. Where the washing water tanks 52, 54 were provided in the squeezing unit 42 for film development, even a small amount of washing water could clean away $S_2O_3$ salt, and image stability on the film was not impaired.

Figure 3:
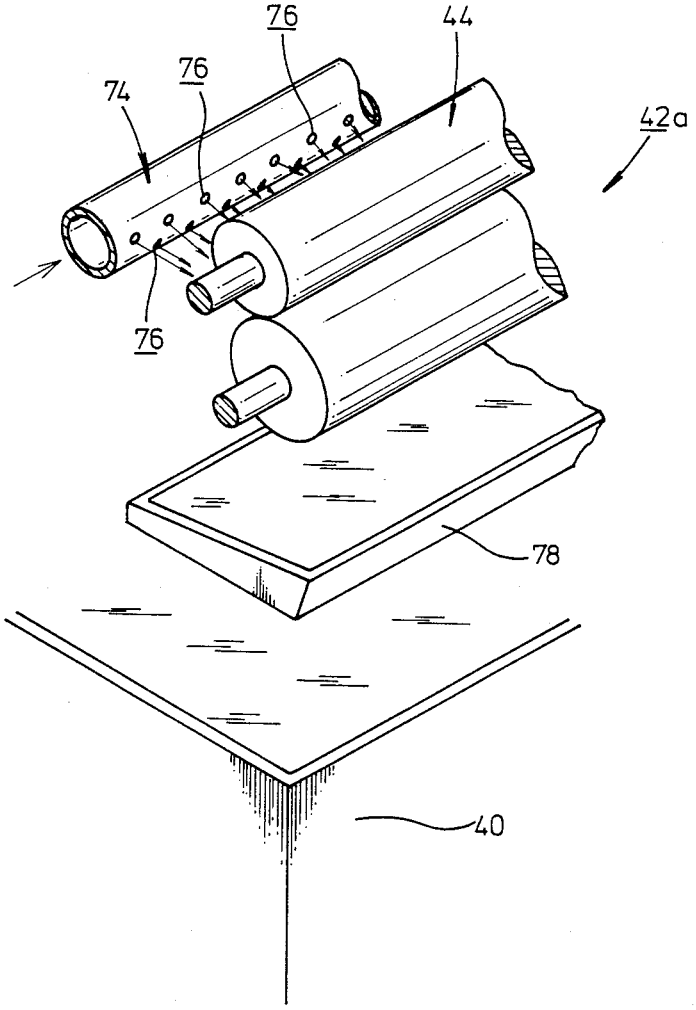
FIG. 3 is a fragmentary perspective view of a squeezing unit according to another embodiment of the present invention.

A squeezing unit according to another embodiment of the present invention is illustrated in FIG. 3. The squeezing unit, generally denoted at 42*a*, has a roller washing pipe 74 disposed near the first roller pair 44. The pipe 74 extends parallel to the axis of the roller pair 44 and has a plurality of small holes 76 defined in its peripheral wall and opening toward the roller pair 44. The pipe 74 is connected to a washing water supply pipe (not shown) and supplied with washing water through a pump (not shown). A receiver tank 78 having different side wall heights is disposed below the pipe 74. Washing water which falls from the roller pair 44 is received by the receiver tank 78, and any excessive water can overlow the tank 78 over the shorter side wall thereof. Therefore, washing water supplied from the pipe 74 to the roller pair 44 can be delivered via the receiver tank 78 into the washing tank 40.

When the pump (not shown) is operated to supply washing water to the pipe 74, the water is ejected from the small holes 76 to the roller pair 44. As a result, any deposits of processing solution components which may be transferred from the film to the roller pair 44 can be removed by the washing water from the pipe 74, so that the roller pair 44 can be kept clean.

In the above embodiments, the water tanks 52, 54 and the washing tank 40 are supplied with an aqueous solution of 0.5 g of disodium ethylenediaminetetraacetic acid-dihydrate per liter of water as a chelating agent. However, it has been confirmed that any of the following kinds of washing water may be used. While various other chelating agents may be employed, aminopolycarboxylic acids and phosphonic acids are particularly preferable.

Specific examples of the aminocarboxylic acids include ethylenediaminetetraacetic acid (EDTA), diethlenetriaminepentaacetic acid, ethylenediamine-N-(betaoxyethyl)-N,N,N',N'-triacetic acid, propylenediaminetetraacetic acid, nitrilotriacetic acid, cyclohexanediaminetetraacetic acid, iminodiacetic acid, alkyliminodiacetic acid, dihydroxyethylglicine, ethyl ether diaminetetraacetic acid, glycol ether diaminetetraacetic acid, ethylenediaminetetrapropionic acid, phenylenediaminetetraacetic acid, 1,3-diamino-2-propanoltetraacetic acid, triethylenetetraminehexaacetic acid, hydroxyethyliminoacetic acid, oxybis(ethyleneoxynitrilo)tetraacetic acid, malic acid, and sodium and potassium salts of these polycarboxylic acids.

Specific examples of the phosphonic acids are those compounds represented by the following general formulae (1)–(5):

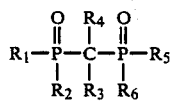

General formula (1)

-continued

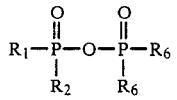

General formula (2)

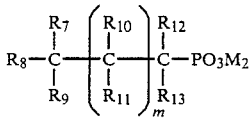

General formula (3)

$R_{14}N(CH_2PO_3M_2)_2$ General formula (4)

General formula (5)

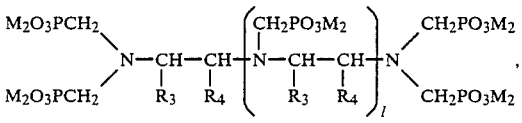

$l = 0, 1, 2$

In the above formulae, $R_1$–$R_6$ independently represent a hydrogen atom, a hydroxyl group, an alkyl group (having 1–3 carbon atoms, e.g., a methyl group, an ethyl group, a propyl group or the like), an amino group, an alkoxy group (having 1–3 carbon atoms, e.g., a methoxy group, an ethoxy gropu or the like), an arylamino group (having preferably 6–8 carbon atoms) and an aryloxy group (having preferably 6–8 carbon atoms). $R_7$–$R_{13}$ independently represent a hydrogen atom, a hydroxyl group, —COOM, —$PO_3M_2$, and an alkyl group (having 1–3 carbon atoms, e.g., a methyl group, an ethyl group, a propyl group or the like). $R_{14}$ represents a hydrogen atom, an alkyl group (having 1–3 carbon atoms, e.g., a methyl group, an ethyl group, a propyl group or the like). M represents an alkali metal such as a sodium atom, a potassium metal or the like. These chelating agents may be added in the form of a sodium or potassium salt. In addition, the chelating agents may be used in combination.

Of these chelating agents, mentioned as preferred are aminocarboxylic acids such as ethylenediaminetetraacetic acid (EDTA), diethylenetriaminepentoacetic acid, ethylenediamine-N-(betaoxyethyl)-N,N,N',N'-triacetic acid, propylenediaminetetraacetic acid, triethylenetetraminehexaacetic acid and the like, phosphonic acids such as ethylenediaminetetramethylenephosphonic acid, and sodium, potassium and ammonium salts of these acids.

Similar effects are obtained when at least one compound selected from the compounds of the following general formulae (6)–(15) is contained in the washing water.

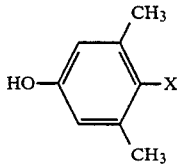

General formula (6)

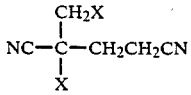

General formula (7)

$XCH_2CONH_2$ General formula (8)

-continued

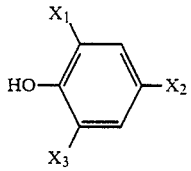

General formula (9)

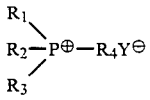

General formula (10)

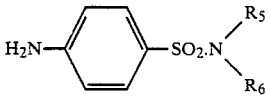

General formula (11)

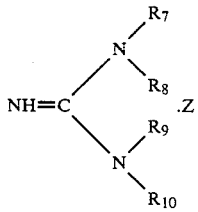

General formula (12)

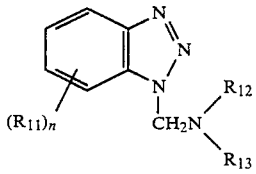

General formula (13)

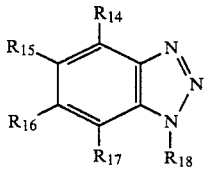

General formula (14)

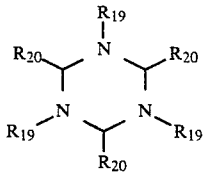

General formula (15)

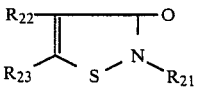

General formula (16)

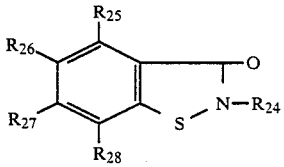

General formula (17)

In the foregoing general formulae (6), (7), (8), and (9), X, and $X_1$, $X_2$ and $X_3$, respectively, represent a halogen atom. Examples of the halogen agom include a fluorine atom, a chlorine atom, a bromine atom, and an iodine atom. $X_1$–$X_3$ may be all the same or different from one another.

In the general formula (10), $R_1$, $R_2$ and $R_3$ independently represent an alkyl group having 1–6 carbon atoms, preferably an alkyl group having 3–6 carbon atoms. The alkyl group may be substituted with a halogen atom (a chlorine atom, a bromine atom or the like) or a hydroxyl group. $R_1$, $R_2$ and $R_3$ may be the same or different.

$R_4$ represents an alkyl group having 1–20 carbon atoms. The alkyl group may be substituted with a halogen atom (a chlorine atom, a bromine atom or the like), a hydroxyl group, a carboxyl group, a sulfone group, a phosphone group, an amino group or the like. An alkyl group having 10–13 carbon atoms is preferred.

T represents a halogen atom and is particularly a fluorine atom, a chlorine atom, a bromine atom or an iodine atom. Of these a chlorine atom or bromine atom is preferred.

In the general formula (11), $R_5$ and $R_6$ are independently a hydrogen atom, an alkyl group, a substituted alkyl group, an aryl group, a substituted aryl group or a nitrogen-containing hetrocyclic group. $R_5$ and $R_6$ may be the same or different.

The alkyl group should preferably have 1–10 carbon atoms, more preferably from 1 to 5 carbon atoms. The substituted alkyl group should preferably have from 1 to 10 carbon atoms in total. The substituents may be a halogen atom, a hydroxyl group, an amino group, a sulfonic acid group, a nitro group, a carboxyl group and the like.

Examples of the aryl group include a phenyl group and a naphthyl group. The substituents for the substituted aryl group may be a halogen atom, an alkyl group, an amino group, a sulfonic acid group, a nitro group and a carboxyl group. The total number of carbon atoms in the aryl group or substituted aryl group is preferably in the range of 6–16, more preferably 6–10.

The nitrogen-containing hetrocyclic group includes, for example, a pyrazole group, an oxazole group, an isooxazole group, a thiazole group, an isothiazole group, a pyridyl group, a pyridazine group or the like. These groups may be substituted with the substituents mentioned above.

Preferably, $R_5$ and $R_6$ are, respectively, a hydrogen atom, an alkyl group, or a nitrogen-containing heterocyclic group which may be substituted.

In the general formula (12), $R_7$, $R_8$, $R_9$ and $R_{10}$ may be the same or different and represent a hydrogen atom or an alkyl group. The alkyl group may be substituted with a halogen atom (e.g., a chlorine atom or a bromine atom). Preferably, three of $R_7$–$R_{10}$ are a hydrogen atom and the other is an alkyl group having 5–20 carbon atoms.

Z represents an acid and is preferably nitrous acid, nitric acid, chloric acid, perchloric acid, carbonic acid, thiocarbonic acid, acetic acid, propionic acid, oxalic acid, benzenesulfonic acid, hydrochloric acid, and picric acid.

In the general formula (13), $R_{11}$ represents a substituent on the benzene ring, including an alkyl group, a halogen atom (e.g., a chlorine atom, a bromine atom or the like), a nitro group, a sulfonic acid group, an amino group or a carboxyl group.

The alkyl group may be substituted with a halogen atom (a chlorine atom, a bromine atom or the like), a hydroxyl group or the like. $R_{11}$ is preferably an alkyl group having 1–2 carbon atoms or a halogen atom.

$R_{12}$ and $R_{13}$ independently represent an alkyl group having preferably from 1 to 5 carbon atoms. The alkyl group may be substituted with a halogen atom, a hydroxyl group, an amino group, a sulfonic acid group, a carboxyl group or the like.

Once again, n is 0 or 1.

In the general formula (14), $R_{14}$, $R_{15}$, $R_{16}$, $R_{17}$ and $R_{18}$ are independently a hydrogen atom, a halogen atom (a chlorine atom, a fluorine atom or the like), an alkyl group, a nitro group, a carboxyl group or a sulfonic acid group and may be the same or different. The alkyl group has preferably 1–10 carbon atoms, more preferably 1–5 carbom atons. The substituted alkyl group should preferably have 1–10 carbon atoms in total. The substituent may be a halogen atom, a hydroxyl group, an amino group, a sulfonic acid group, a nitro group, a carboxyl group or the like.

$R_{14}$–$R_{18}$ are preferably a hydrogen atom, a halogen atom, a lower alkyl group or a hydroxyl group. Most preferably, $R_{14}$–$R_{18}$ are all a hydrogen atom.

In the general formula (15), $R_{19}$–$R_{20}$, respectively, represent a hydrogen atom, or an alkyl group, an aryl group, an alkenyl group, an alkoxy group, a hydroxyl group, an acyl group, a sulfonil group, an alkylthio group, an arylthio group, a heterocyclic residue, a carbamoyl group or a sulfamoyl group.

These substituents may be substituted with other substituents (including, for example, a hydroxyl group, an acyl group, a sulfonyl group, a halogen atom, an amino group, a carboxyl group or the like, of which a hydroxyl group or a halogen atom is preferred.). The total number of carbon atoms in the substituents represented by $R_{19}$ and $R_{20}$ was found to be preferably in the range not larger than 10.

It has been found that $R_{19}$ is preferably a hydrogen atom, an alkyl group, an aryl group, an alkenyl group, an aralkyl group, a hydroxyl group, a acyl group, a sulfonyl group or a heterocyclic group, of which a hydrogen atom or an alkyl group is more preferable.

It has been confirmed that $R_{19}$ and $R_{20}$ may be the same or different and, preferably either $R_{19}$ or $R_{20}$ is a hydrogen atom.

In the general formulae (16) and (17), $R_{21}$ represents a hydrogen atom, a halogen atom, an alkyl group, an aryl group, a halide alkyl group, $—R_{29}—O—R_{30}$, $—CONHR_{31}$ and an arylalkyl group. $R_{22}$ and $R_{23}$ are independently a hydrogen atom, a halogen atom and a halide alkyl group. $R_{24}$ represents a hydrogen atom, a halogen atom, an alkyl group, an aryl group, a halide alkyl group, an arylalkyl group, $—R_{32}—O—R_{33}$ and $—CONH_{34}$. $R_{25}$, $R_{26}$, $R_{27}$, $R_{28}$ independently represent a hydrogen atom, a halogen atom, a hydroxyl group, an alkyl group, a amino group and a nitro group.

Instead of adding the compounds to the washing water to prevent the growth of bacterial slime in the washing water, ultraviolet radiation or a magnetic field may be applied to the washing water, or the washing water may be subjected to an ion exchange to produce deionized washing water.

Application of a magnetic field to the washing water may be effected by passing the washing water through a magnetic field produced by positive and negative magnetic poles. The magnetic field can be generated by a permanent magnet made of ferromagnetic materials such as iron, cobalt, and nickel, or by passing a current through a coil or the like. The magnetic field may also be formed by any other suitable means. The magnetic field may be generated by lines of magnetic force produced by a single magnet or lines of magnetic force produced between two magnets (positive and negative magnetic poles) which face each other.

The washing water may be passed through the magnetic field by moving or rotating a permanent magnet or magnets inside or outside of the water tank, or moving the washing water with respect to a permanent magnet or magnets by stirring or circularing the water. Preferably, the water may be circulated through a water circulation pipe with a permanent magnet or magnets disposed inside or outside of the pipe and attached to a portion of or the entire pipe.

The washing water may be exposed to ultraviolet radiation emitted from a commercially available ultraviolet lamp or ultraviolet applicator. Preferably, the ultraviolet lamp should have a tube output ranging from 5 W to 800 W, but is not limited to such an output. The ultraviolet radiation should preferably be of a wavelength ranging from 220 nm to 350 nm.

The washing water may be deionized by removing calcium and magnesium ions therefrom with a mixed-bed column filled with an H-type strongly acidic cation exchange resin and an OH-type strongly basic exchange resin. Distilled water may also be used as the washing water.

A process of applying ultraviolet radiation to washing water is disclosed in Japanese Laid-Open Patent Publication No. 60-263939. A process of passing washing water through a magnetic field is disclosed in Japanese Laid-Open Patent Publication No. 60-263940. A processing of deionizing washing water with an ion exchange resin is disclosed in Japanese Patent Application No. 61-131632.

With the arrangement of the present invention, the roller washing means is associated with roller pairs of the squeezing unit for supplying washing water to remove deposits of processing solution components which have been attached to the roller pairs from the photosensitive material that was immersed in and passed through the processing solutions. Therefore, no processing solution components remain attached to the roller pairs, and hence are transferred to the photosensitive material from the roller pairs even when the photosensitive material is subjected to intermittent development. Processing solution components are thus prevented from being attached to localized areas of the photosensitive material. Since the film washing tank is not required to be supplied with a large amount of washing water at all times or a multiplicity of washing tanks do not need to be provided, but only an amount of washing water which is large enough to clean the roller pairs suffices, the required amount of washing water can be saved. The automatic image developing apparatus is consequently small in size and can be manufactured economically.

The present invention is not limited to the illustrated embodiments, but other modifications may be made. For example, a medical or industrial X-ray photographic material, an X-ray dupe photographic material, a photographic material for use in medical CRT imaging, and printing photosensitive material. The roller washing means may be associated with the roller pair of the squeezing unit which first grips the photosensitive material delivered from the washing tank, and other roller pairs may also be associated with respective roller washing means, if required.

Although certain preferred embodiments have been shown and described, it should be understood that many changes and modifications may be made therein without departing from the scope of the appended claims.

What is claimed is:

1. An automatic image developing apparatus for a halide silver photographic photosensitive material, comprising a developing tank, a fixing tank, a washing tank for successively delivering therethrough the halide silver photographic photosensitive material which has been exposed or has recorded an image thereon, said washing tank being supplied with washing water at a rate of 2 liters or less per 1 $m^2$ of the photographic photosensitive material, a drying unit for drying the photographic photosensitive material, a plurality of roller pairs for squeezing water from the photographic photosensitive material fed from said washing water toward said drying unit, the roller washing means associated with at least a first one of said roller pairs which is closest to said washing tank to grip the photographic photosensitive material from said washing tank, for washing said at least one roller pair at all times, wherein said roller washing means comprises a roller washing water tank, said at least one roller pair having upper and lower rollers, at least said lower roller being partly immersed in said roller washing water tank, and wherein said roller washing water tank is supplied with washing water, and includes means for introducing excessive washing water from said roller washing water tank into said washing tank.

2. An automatic image developing apparatus according to claim 1, wherein said introducing means comprises one side wall of said roller washing water tank, said one side wall being substantially shorter than an opposite side wall of the roller washing water tank.

3. An automatic image developing apparatus according to claim 2, wherein said one side wall has a recess which makes said one side wall shorter than said opposite side wall.

4. An automatic image developing apparatus according to claim 1, wherein said introducing means comprises a washing water discharge hole defined in one side wall of said roller washing water tank.

5. An automatic image developing apparatus according to claim 1, wherein said developing, fixing, and washing tanks are employed for processing a black-and-white photosensitive material.

6. An automatic image developing apparatus according to claim 1, wherein said washing water comprises water with at least one compound selected from the group consisting of aminopolycarboxylic acids and phosphonic acids being added to the water.

7. An automatic image developing apparatus according to claim 1, wherein said washing tank reserves said washing water which is processed by at least one of exposure to untraviolet radiation, application of a magnetic field, and deionization with an ion exchange resin.

8. An automatic image developing apparatus for a halide silver photographic photosensitive material, comprising a developing tank, a fixing tank, a washing tank for successively delivering therethrough the halide silver photographic photosensitive material which has been exposed or has recorded an image thereon, said washing tank being supplied with washing water at a rate of 2 liters or less per 1 $m_2$ of the photographic photosensitive material, a drying unit for drying the photographic photosensitive material, a plurality of roller pair for squeezing water from the photographic photosensitive material fed from said washing water toward said drying unit, and roller washing means associated with at least a first one of said roller pairs which is closest to said washing tank to grip the photographic photosensitive material from said washing tank, for washing said at least one roller pair at all times, wherein said roller washing means comprises a roller washing water tank assembly including a first water tank and a second water tank, said roller pairs including said first roller pair associated with said first water tank and a second roller pair associated with said second water tank.

9. An automatic image developing apparatus according to claim 8, wherein said second water tank is disposed to deliver excessive washing water therefrom into said first water tank, and said first water tank is disposed to deliver excessive washing water therefrom into said washing tank.

10. An automatic image developing apparatus for a halide silver photographic photosensitive material, comprising a developing tank, a fixing tank, a washing tank for successively delivering therethrough the halide silver photographic photosensitive material which has been exposed or has recorded an image thereon, said washing tank being supplied with washing water at a rate of 2 liters or less per 1 $m_2$ of the photographic photosensitive material, a drying unit for drying the photographic photosensitive material, a plurality of roller pairs for squeezing water from the photographic photosensitive material fed from said washing water toward said drying unit, and roller washing means associated with at least a first one of said roller pairs which is closest to said washing tank to grip the photographic photosensitive material from said washing tank, for washing said at least one roller pair at all times, wherein said roller washing means comprises a roller washing pipe disposed adjacent to said first roller pair and having an opening for ejecting washing water to one roller of said first roller pair to clean said first roller pair, and further including a receiver tank for receiving and delivering washing water ejected from said roller washing pipe into said washing tank.

11. An automatic image developing apparatus according to claim 10 wherein said receiver tank has longer and shorter side walls, said shorter side wall being arranged to allow washing water ejected from said roller washing pipe to overflow thereover into said washing tank.

12. An automatic image developing apparatus according to any one of claims 1, 2 through 4 and 8 through 11, for a roller-fed black-and-white photosensitive material.

13. An automatic image developing apparatus according to any one of claims 1, 2 through 4 and 8 through 11 wherein said roller washing means is disposed downwardly of said washing tank and comprises a single tank and a roller pair immersed in said single tank.

14. An automatic image developing apparatus for a halide silver photographic photosensitive material, comprising a developing tank, a fixing tank, a washing tank for successively delivering therethrough the halide silver photographic photosensitive material which has been exposed or has recorded an image thereon, said washing tank being supplied with washing water at a rate of 2 liters or less per 1 $m^2$ of the photographic photosensitive material, a drying unit for drying the photographic photosensitive material, a plurality of roller pairs for squeezing water from the photographic photosensitive material fed from said washing water toward said drying unit, and roller washing means associated with at least a first one of said roller pairs which is closest to said washing tank to grip the photographic photosensitive material from said washing tank, for washing said at least one roller pair at all times, wherein said washing water comprises water with at least one compound selected from the group consisting of aminopolycarboxylic acids and phosphonic acids being added to the water.

15. An automatic image developing apparatus for a halide silver photographic photosensitive material, comprising a developing tank, a fixing tank, a washing tank for successively delivering therethrough the halide silver photographic photosensitive material which has been exposed or has recorded an image thereon, said washing tank being supplied with washing water at a rate of 2 liters or less per 1 $m^2$ of the photographic photosensitive material, a drying unit for drying the photographic photosensitive material, a plurality of roller pairs for squeezing water from the photographic photosensitive material fed from said washing water toward said drying unit, and roller washing means associated with at least a first one of said roller pairs which is closest to said washing tank to grip the photographic photosensitive material from said washing tank, for washing said at least one roller pair at all times, wherein said washing tank reserves said washing water which is processed by at least one of exposure to ultraviolet radiation, application of a magnetic field, and deionization with an ion exchange resin.

* * * * *